United States Patent [19]

Joannou

[11] Patent Number: 4,828,586

[45] Date of Patent: May 9, 1989

[54] CARTRIDGE TYPE ELECTRONIC AIR FILTER

[76] Inventor: Constantinos J. Joannou, 49 Mill Street, #4, Carleton Place, Ontario, Canada, K7C 1T6

[21] Appl. No.: 165,384

[22] Filed: Feb. 29, 1988

Related U.S. Application Data

[63] Continuation of Ser. No. 929,307, Nov. 12, 1986, abandoned.

[30] Foreign Application Priority Data

Nov. 13, 1985 [CA] Canada ..... 495236

[51] Int. Cl.[4] ..... B03C 3/00

[52] U.S. Cl. ..... 55/131; 55/139; 55/155

[58] Field of Search ..... 55/131, 132, 139, 155

[56] References Cited

U.S. PATENT DOCUMENTS

| | | | |
|---|---|---|---|
| 2,589,463 | 3/1952 | Warburton | 55/131 |
| 2,969,127 | 1/1961 | Cook | 55/126 |
| 3,140,935 | 7/1964 | Flagg | 55/139 |
| 3,188,784 | 6/1965 | Nodolf | 55/139 X |
| 3,222,848 | 12/1965 | Koble, Jr. | 55/131 |
| 3,271,932 | 9/1966 | Newell | 55/132 |
| 3,438,180 | 4/1969 | Klouda | 55/131 X |
| 3,509,696 | 5/1970 | Thompson | 55/131 |
| 3,581,462 | 6/1971 | Stump | 55/131 X |
| 3,626,668 | 12/1971 | Cardiff | 55/138 X |
| 3,626,669 | 12/1971 | Cardiff | 55/137 X |
| 3,665,679 | 5/1972 | McLain et al. | 55/137 |
| 3,733,783 | 5/1973 | Burney | 55/138 X |
| 3,735,560 | 5/1973 | Wellman | 55/131 X |
| 3,973,932 | 8/1976 | Alskog | 55/132 |
| 3,989,486 | 11/1976 | Baysinger | 55/138 X |
| 4,022,594 | 5/1977 | Baysek | 55/139 |
| 4,341,537 | 7/1982 | Rodgers | 55/139 |
| 4,507,131 | 3/1985 | Fathauer et al. | 55/139 X |
| 4,549,887 | 10/1985 | Joannou | 55/131 |
| 4,559,594 | 12/1985 | Sears et al. | 55/139 X |

FOREIGN PATENT DOCUMENTS

| | | | |
|---|---|---|---|
| 766263 | 6/1934 | France | 55/131 |

*Primary Examiner*—Bernard Nozick

*Attorney, Agent, or Firm*—Jones, Tullar & Cooper

[57] ABSTRACT

This invention relates to an electronic air filter of the charged media type in which the filter media and screens form a disposable cartridge. The high voltage power supply, which is made long and slender, attaches to the side of the cartridge and it is powered by a low voltage power supply.

7 Claims, 3 Drawing Sheets

CARTRIDGE TYPE ELECTRONIC AIR FILTER

This application is a continuation of application Ser. No. 929,307, filed Nov. 12, 1986, now abandoned.

This invention relates to an electronic air filter of the charged media type in which the screens and media form a disposable cartridge. This feature makes restoration of a saturated filter easy and sanitary.

Presently available electronic air filters are cleaned by either washing collector plates which accumulate the dust (precipitator type filters), or opening the filter and removing and replacing individual pads (charged media type filters). In cleaning these filters, some of the collected dust falls off the pads, becomes airborne and thus causes pollution.

It is the object of may invention to provide an electronic air filter in which the dust collecting media is in the form of a disposable cartridge.

The installation of such a filter is easy and safe as two power supplies are provided, one being a low voltage power supply which plugs into the power supply and the other being a high voltage power supply which is powered by the low voltage power supply via a low voltage detachable cord. The high voltage power supply attaches to the cartridge.

The electronic air filter which, although it utilizes several thousand volts for its operation, is made safe by preferably providing an interlock switch which removes the high voltage from the high voltage power supply.

The filter can also be connected in tandem with other similar filters and be powered by a single high voltage power supply. These and other features of the invention will become evident from the drawings and description provided.

Figure 3:
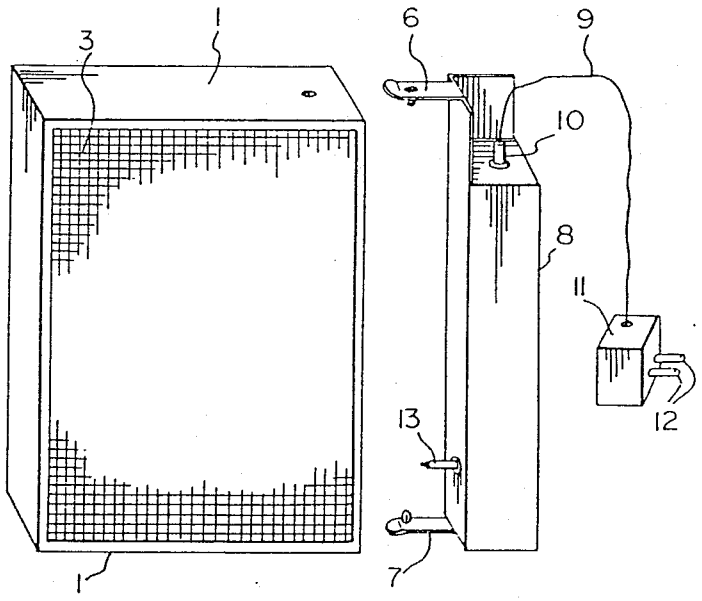
FIG. 3 shows an exploded view of the filter, the high voltage power supply having a high voltage probe and the lower voltage supply being connected to it.
Figure 1:
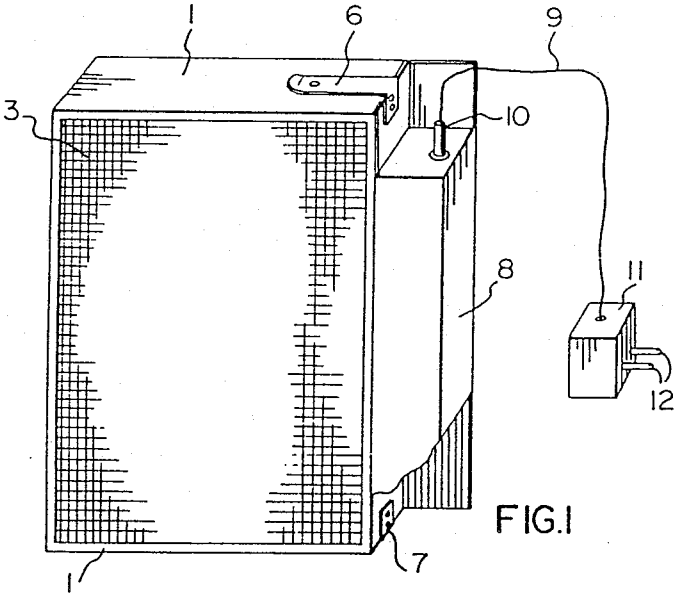
FIG. 1 shows the cartridge type filter of this invention with a high voltage supply attached to the cartridge and a low voltage power supply connected to the high voltage supply by a detachable cord.
Figure 2:
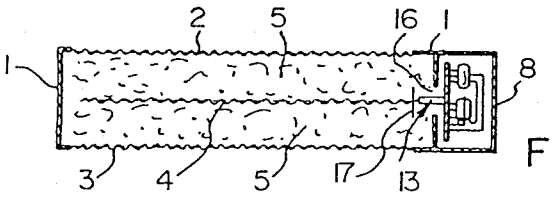
FIG. 2 is a cross-sectional view of the cartridge of FIG. 1 showing the two outside screens and the single inside screen.
Figure 4B:
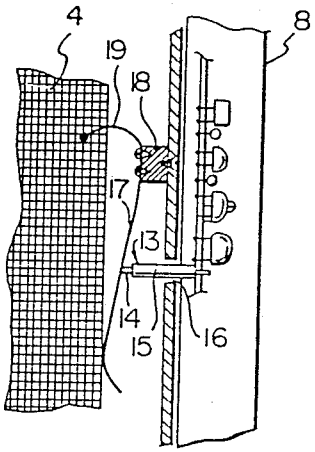
FIGS. 4A and 4B are partial cross-sectional views showing the action of a shorting switch when the high voltage probe is inserted in an aperture on the cartridge.
Figure 4A:
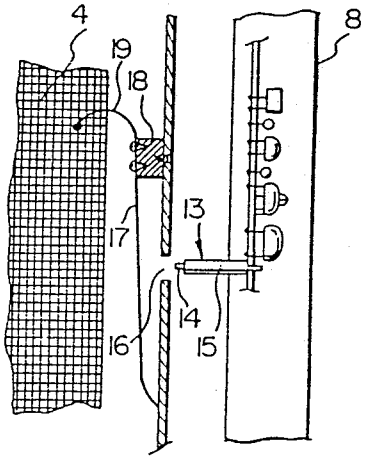

Referring to the drawings, in FIG. 1 and FIG. 2, 1 is an outside rectangular frame made of a material such as an electrically conducting cardboard, plastic or metal. 2 and 3 are electrically conducting outside screens which are held together by frame 1. Screens 2 and 3 are electrically connected together. Screens 2 and 3 are also electrically connected to retainer clips 6 and 7 via frame 1. 4 is an inside conducting screen which is held in position between screens 2 and 3 by fibrous material 5. Fibrous material 5 is made of a dielectric material such as plastic or glass which is easily polarizable by an electrostatic field. 8 is a long and slender metal box containing the high voltage supply electronics (see also FIG. 3). 11 is a low voltage power supply which can be plugged into a household electrical socket by prongs 12. 9 is a cord (two conductor cable) which is plugged into high voltage power supply 8 by connector 10 (plug and socket). High voltage power supply 8 is provided with high voltage probe 13 (see FIG. 4A and 4B). Probe 13 consists of a conductor 14 and an insulating sleeve 15 covering the conductor so that only a small part of the tip is exposed. The cartridge filter is provided with an opening 16 on outside frame 1 where probe 13 can be inserted to provide high voltage for the filter. 17 is a flat metal spring element which is affixed by insulator 18 to the inside of frame 1. Also spring 17 is connected to inside screen 4 by wire 19. Spring element 17 is arranged so that when probe 13 is inserted in opening 16, spring 17 makes contact with the tip of probe 13 and at the same time spring 17 is lifted off frame 1 by probe 13 and it breaks electrical contact with frame 1. This occurs when the high voltage power supply is attached to the cartridge and held in place by clips 6 and 7.

Operation of the filter is as follows:

High voltage power supply 8 is attached to the cartridge filter by retainer clips 6 and 7. Low voltage power supply 11 is plugged into an electrical outlet and cord 9 is plugged into high voltage power supply 8 via connector 10. Thus low voltage (6–28 volts) is supplied to the high voltage power supply. High voltage (4–10 KV) from the high voltage power supply is provided to inside screen 4 via probe 13, spring element 17 and wire 19. The high voltage applied to inside screen 4 sets up on electrostatic field between inside screen 4 and outside screens 2 and 3. (Note that the outside screens are connected to the ground side of the high voltage power supply via frame 1 and retainer clips 6 and 7). The electrostatic field polarizes the fibers of fibrous material 5 which is located between the screens. The polarized fibers, which exhibit positive and negative charges on their surfaces, attract any dust particles which pass through the filter by electrostatic attraction. In this way the efficiency of the filter is enhanced.

To replace the cartridge after it has been saturated with dust, the low voltage power supply is disconnected from the high voltage power supply by disconnecting connector 10. Then the high voltage power supply 8 is detached from the cartridge by spreading retainer clips 6 and 7 apart. When the high voltage power supply is detached from the cartridge and probe 13 is pulled out of opening 16 (FIG. 4A), spring element 17 connects inside screen 4 to frame 1 (ground) and discharges the charge on screen 4 via wire 19.

Figure 5:
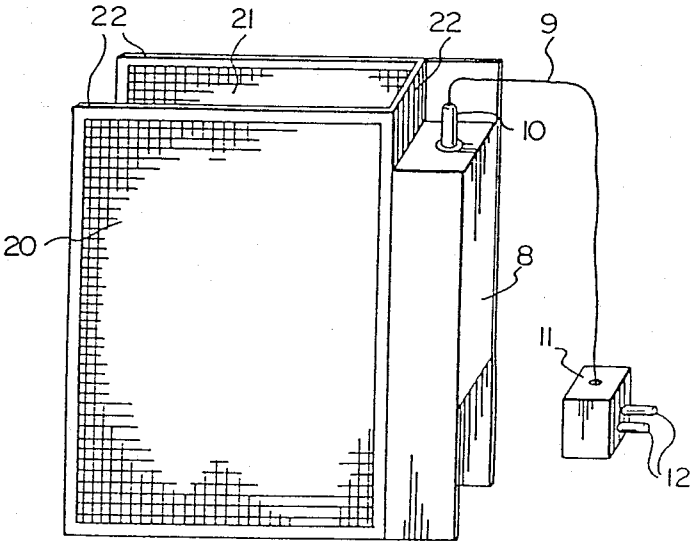
FIG. 5 shows an alternate arrangement wherein the high voltage power supply is provided with screens.
Figure 6:
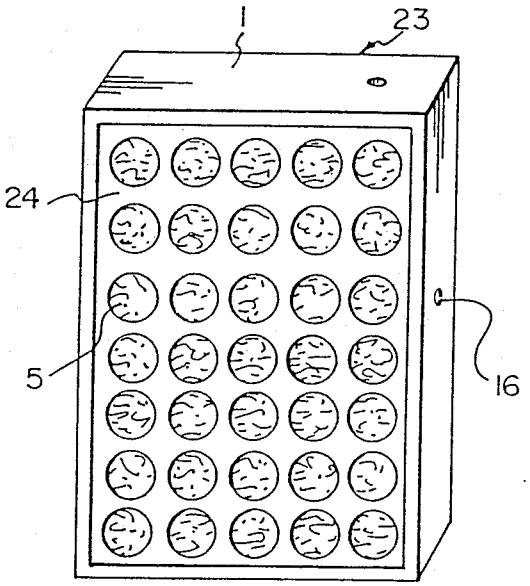
FIG. 6 is an outside view of the alternate type cartridge filter of FIG. 5.
Figure 7:
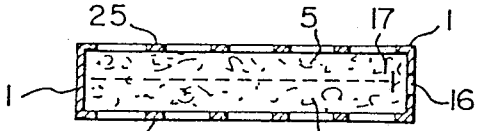
FIG. 7 is a cross-sectional view of the cartridge shown in FIG. 6.

An alternate version of the cartridge filter system comprises two outside screens, 20 and 21 (FIG. 5) supported by frame 22. Frame 22 is permanently attached to high voltage power supply box 8. The arrangement is such that there is space between screen 20 and 21 for a cartridge 23 (FIG. 6) which is similar to the one described before, but without outside screen 2 and 3. Instead of screens 2 and 3, cartridge 23 has two perforated retainer sides 24 and 25 made of metal, cardboard, plastic etc. The rest of cartridge 23 is made exactly the same as the cartridge shown in FIG. 1, i.e. it has outside frame 1, inside screen 4, opening 16, spring 17, wire 19 and insulator 18.

Operation of the alternate arrangement is similar to the operation of the first arrangement. Cartridge 23 is placed between screens 20 and 21 and held in place by retainer clips 6 and 7. At the same time high voltage probe 13 (not shown in FIG. 5) passes through opening 16 and supplied high voltage to inside screen 4 via spring 17 and wire 19. Electrostatic field is set up between inside screen 4 and outside screen 20 and 21 which polarizes fibrous materials and thus attracts any dust particles which pass through the cartridge.

Figure 8:
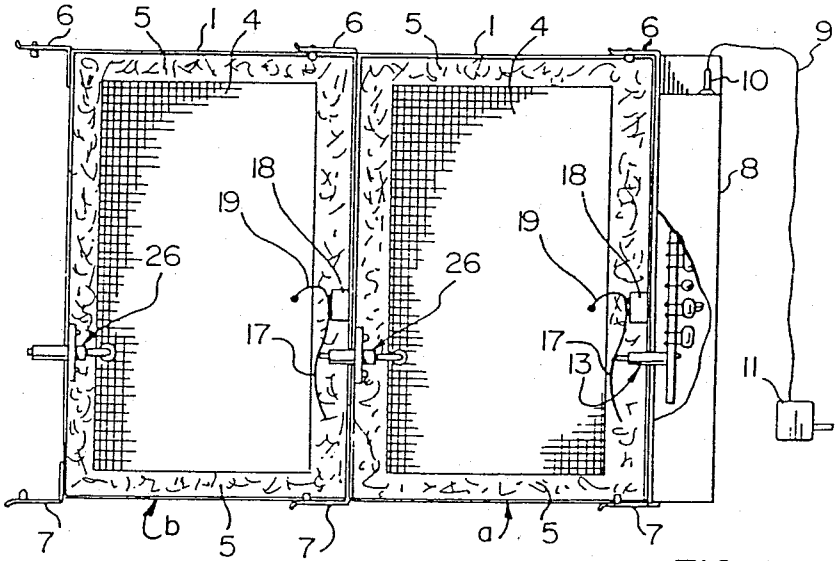
FIG. 8 is a view of two filters connected in tandem showing the high voltage probes and a single high voltage power supply.

In filtering systems, sometimes many small filters are used in tandem to cover a larger area in a duct. Using the cartridge type approach, it is possible to drive several filter cartridges in tandem using only one high voltage power supply. FIG. 8 shows such an arrangement. Power supply 8 provides high voltage to inside screen 4 of cartridge a via probe 13, spring 17 and wire 19. Inside screen 4 is connected to the next filter b by high voltage probe 26. Probe 26 is similar to probe 13 in that it features a conductor inside an insulating sleeve. The sleeve is supported on outside frame 1 by a flange. Probe 26 supplies high voltage to screen 4 of cartridge b via spring 17, and wire 19 of cartridge b. Cartridge b is identical to cartridge a and is also provided with a probe 26, which can supply high voltage to a third identical cartridge (not shown). Both cartridge a and b are provided with upper retainer clips 6 and lower retainer clips 7. By means of clips 6 and 7 these cartridges are attached to each other firmly so that probes 26 and 13 maintain good electrical contact with springs 7.

Figure 9:
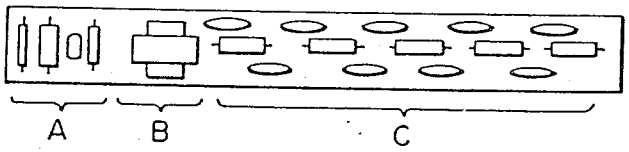
FIG. 9 shows the elongated design of the high voltage power supply.

Filters of the charged media type are usually made thin (about 1 inch thick.) Because of this, the high voltage power supply has to be made long and slender so that, when attached to the cartridge, form a thin filter. To achieve this, the high voltage power supply electronics (see FIG. 9) is made of three parts A, B, and C. A is an electronic oscillator which drives transformer B. Transformer B provides about one tenth of the high voltage supply's output. Part C is a voltage multiplier which boosts the transformer's output to the final high voltage. By using this design the voltage in the supply is gradually building up to the high voltage required to drive the filter without having any close parts at high potential difference. Therefore, this design can be built on a narrow and long printed circuit board which can be contained in a long and slender box.

The embodiments of the invention in which an exclusive property or privilege is claimed are defined as follows:

1. A combination electronic cartridge air filter and power supply unit for removable insertion into an air handling system comprising:

at least a first disposable filter cartridge which includes:

(a) a frame;

(b) first and second spaced outside conducting screens attached to said frame;

(c) an inside conducting screen disposed within said frame between said outside conducting screens; and, (d) nonconducting dielectric fibrous material disposed between said outside and inside conducting screens, and surrounding said inside conducting screen; and, a removable power supply unit including:

(a) a high voltage power supply;

(b) a box containing said power supply;

(c) means on said box to removably mechanically attach said box in a supported manner directly and solely to said filter cartridge frame; and, (d) a high voltage probe extending from said box, and passing through an opening in said frame to electrically contact a conductor means which is electrically connected to said inside conducting screen.

2. The cartridge air filter and power supply unit of claim 1, wherein said inside conducting screen is held in place by said dielectric fibrous material.

3. The cartridge and air filter power supply unit of claim 1 wherein, said conductor means comprises a spring element attached to said inside conducting screen, and positioned to contact said probe means when said power supply unit is attached to said cartridge, and contact said frame when said power supply unit is removed from said cartridge, to automatically discharge any electrical charge on said inside conducting screen.

4. The cartridge air filter and power supply unit of claim 1, wherein said box is mechanically attached in a supported manner directly to said filter cartridge with a pair of retainer clips that are attached to said box, and engage the cartridge frame.

5. The cartridge air filter and power supply unit of claim 1, further including at least a second disposable filter cartridge; and means to mechanically and electrically connect said unit to said second disposable filter cartridge in a side by side manner to form a train of filter cartridges that are powered by said high voltage power supply.

6. The high voltage power supply unit of claim 1, wherein said power supply includes: an electronic oscillator; a transformer driven by said oscillator; and, a voltage multiplier connected to said transformer.

7. A combination electronic cartridge air filter and power supply unit for removable insertion into an air handling system comprising:

at least a first disposable filter cartridge which includes:

(a) a frame;

(b) first and second spaced perforated retainer sides attached to said frame;

(c) an inside conducting screen disposed within said frame between said perforated retainer sides; and, (d) nonconducting dielectric fibrous material disposed between said perforated retainer sides and said inside conducting screen, and surrounding said inside conducting screen; and, a removable power supply unit including:

(a) a high voltage power supply;

(b) a box containing said power supply;

(c) a frame attached to said box including first and second spaced parallel outside conducting screens;

(d) means on said box to removably mechanically attach said box in a supported manner directly and solely to said filter cartridge frame; and, (e) a high voltage probe extending from said box, and passing through an opening in said frame to electrically contact a conductor means which is electrically connected to said inside conducting screen.

* * * * *